United States Patent [19]

Sasaki et al.

[11] Patent Number: 4,594,317

[45] Date of Patent: Jun. 10, 1986

[54] SILVER HALIDE PHOTOGRAPHIC LIGHT-SENSITIVE MATERIAL

[75] Inventors: Noboru Sasaki; Shunichi Aida; Tadashi Ikeda, all of Kanagawa, Japan

[73] Assignee: Fuji Photo Film Co., Ltd., Kanagawa, Japan

[21] Appl. No.: 681,743

[22] Filed: Dec. 14, 1984

[30] Foreign Application Priority Data

Dec. 15, 1983 [JP] Japan ..... 58-237067

[51] Int. Cl.[4] ..... G03C 1/02

[52] U.S. Cl. ..... 430/574; 430/567; 430/572

[58] Field of Search ..... 430/574, 569, 567, 572

[56] References Cited

U.S. PATENT DOCUMENTS

| | | | |
|---|---|---|---|
| 3,580,724 | 5/1971 | Sato | 430/574 |
| 3,840,373 | 10/1974 | Shiba et al. | 430/574 |
| 3,854,955 | 12/1974 | Shiba et al. | 430/574 |
| 4,362,813 | 12/1982 | Mihara et al. | 430/574 |
| 4,414,310 | 11/1983 | Daubendiek et al. | 430/567 |

*Primary Examiner*—Mary F. Downey

*Attorney, Agent, or Firm*—Sughrue, Mion, Zinn, Macpeak, and Seas

[57] ABSTRACT

A silver halide photographic light-sensitive material comprising a support having provided thereon at least one silver halide emulsion layer in which at least 50% of the total projected surface area of the total silver halide grains comprises tabular silver halide grains having a means aspect ratio of 5:1 or more and which has been spectrally sensitized by a specific combination of sensitizing dyes. The material exhibits excellent stability on storage.

17 Claims, No Drawings

SILVER HALIDE PHOTOGRAPHIC LIGHT-SENSITIVE MATERIAL

FIELD OF THE INVENTION

This invention relates to a silver halide photographic light-sensitive material and, more particularly, to a silver halide photographic light-sensitive material having excellent preservability.

BACKGROUND OF THE INVENTION

It is known that the sensitivity of a silver halide photographic light-sensitive material obtained by spectral sensitization, i.e., spectral sensitivity, is influenced both by the structures of sensitizing dyes used and by various properties of emulsions, such as silver halide composition, crystal structure, crystal habit, silver ion concentration, hydrogen ion concentration and the like, as well as by photographic additives present in emulsions. Further, the sensitizing dyes cannot remain in the processed light-sensitive material to cause discoloration. In particular, with a recently increasing demand for rapid processing, it is important that the sensitizing dyes not remain in the processed light-sensitive material to cause discoloration and do not cause fog in short time processing (usually several seconds to several tens of seconds).

In general, the spectral sensitivity of a light-sensitive material can be broadened to a prescribed spectral wavelength region by using one sensitizing dye. However, the combined use of two or more different sensitizing dyes (supersensitization) frequently results in a lower sensitivity compared with the sensitivity obtained with their individual use. Therefore, when super-sensitization is attempted using a combination of sensitizing dyes, groups of dyes which can be used in combination must be carefully selected for compatibility.

Light-sensitive silver halide emulsions exhibiting a high spectral speed and excellent sharpness have recently been developed using tabular silver halide grains with high aspect ratios (ratios of grain diameter to grain thickness). However, these silver halide emulsions have the disadvantage that sensitivity and contrast are greatly varied by latensification after exposure even if the emulsions are spectrally sensitized by commonly employed sensitizing dyes (e.g., benzimidazole) under optimum conditions, with the result that normal images cannot be formed. In addition, storage of those materials for a long period of time increases fog and reduces sensitivity. Japanese Patent Application (OPI) Nos. 108526/83 and 113927/83 disclose technique for spectral sensitization of tabular silver halide grains, but these prior art techniques do not provide satisfactory photographic properties such as sensitivity.

SUMMARY OF THE INVENTION

As a result of extensive studies, the present inventors have discovered that it is possible to increase the spectral sensitivity of emulsions containing high-aspect ratio tabular silver halide grains and, at the same time, to improve stability of latent images and preservability of images by supersensitization, by using a combination of certain sensitizing dyes.

Accordingly, an object of this invention is to provide a silver halide photographic light-sensitive material which exhibits high latent image stability, and particularly, one which is free from changes in sensitivity and contrast due to latensification after exposure and fog caused by storage for a long time.

Another object of this invention is to provide a specific combination of sensitizing dyes which is suitable for sensitizing tabular silver halide emulsions to achieve high spectral sensitivity, to reduce generation of fog and to ensure preservability for a long period of time, and which does not remain in processed light-sensitive materials to cause discoloration.

These objects of the present invention can be accomplished by a silver halide photographic light-sensitive material comprising a support and at least one silver halide emulsion layer, wherein at least 50% of the total projected surface area of silver halide grains comprises tabular silver halide grains having a mean aspect ratio of 5:1 or more and the emulsion has been spectrally sensitized by a mixed sensitizing dye comprising a sensitizing dye represented by the following formula (Ib) and at least one sensitizing dye selected from the group consisting of sensitizing dyes represented by the following formula (IIb) and sensitizing dyes represented by the following formula (IIIb):

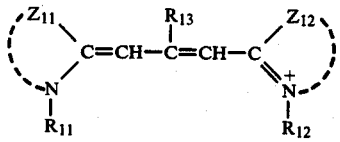

(Ib)

wherein $R_{11}$ and $R_{12}$, which may be the same or different, each represents a substituted or unsubstituted alkyl group, a substituted or unsubstituted alkenyl group or a substituted or unsubstituted aralkyl group; $R_{13}$ represents a hydrogen atom, an aryl group or an alkyl group having 1 to 4 carbon atoms; and $Z_{11}$ and $Z_{12}$, which may be the same or different, each represents a substituted or unsubstituted atomic group necessary to form an oxazole ring, a benzoxazole ring or a naphthoxazole ring (e.g., naphtho[2,1-d]oxazole, naphtho[1,2-d]oxazole, naphtho[2,3-d]oxazole or 8,9-dihydronaphtho[1,2-d]oxazole) together with the adjacent N or $N^+$, respectively:

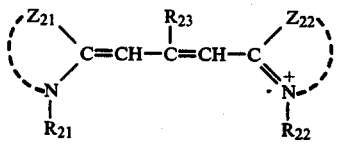

(IIb)

wherein $R_{21}$ and $R_{22}$, which may be the same or different, each represents a substituted or unsubstituted alkyl group, a substituted or unsubstituted alkenyl group or a substituted or unsubstituted aralkyl group; $R_{23}$ represents a hydrogen atom, an aryl group or an alkyl group having 1 to 4 carbon atoms; $Z_{21}$ represents a substituted or unsubstituted atomic group necessary to form an oxazole ring, a benzoxazole ring or a naphthoxazole ring (e.g., naphtho[2,1-d]oxazole, naphtho[1,2-d]oxazole, naphtho[2,3-d]oxazole or 8,9-dihydronaphto[1,2-d]oxazole) together with the adjacent N atom; and $Z_{22}$ represents a substituted or unsubstituted atomic group necessary to form a benzothiazole ring, a thiazole ring, a naphthothiazole ring (e.g., naphtho[1,2-d]thiazole, naphtho[2,1-d]thiazole, naphtho[2,3-d]thiazole or 8,9-dihydronaphtho[1,2-d]thiazole), a selenazole ring, a benzoselenazole ring or a naphthoselenazole ring (e.g., naphtho[1,2-d]selenazole, naphtho[2,1-d]selenazole or naphtho[2,3-d]selenazole) together with the adjacent N+:

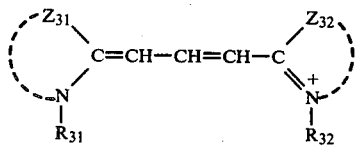

(IIIb)

wherein $R_{31}$ and $R_{32}$, which may be the same or different, each represents a substituted or unsubstituted alkyl group, a substituted or unsubstituted alkenyl group or a substituted or unsubstituted aralkyl group; $Z_{31}$ represents a substituted or unsubstituted atomic group necessary to form an oxazole ring, a benzoxazole ring or a naphthoxazole ring (e.g., naphtho[2,1-d]oxazole, naphtho[1,2-d]oxazole, naphtho[2,3-d]oxazole or 8,9-dihydronaphtho[1,2-d]oxazole) together with the adjacent N atom; and $Z_{32}$ represents a substituted or unsubstituted atomic group necessary to form a benzimidazole ring or a naphthoxazole ring (e.g., naphtho[2,3-d]imidazole or naphtho[1,2-d]imidazole) together with the adjacent N+.

DETAILED DESCRIPTION OF THE INVENTION

The term "mean aspect ratio" as used herein means the mean value of diameter to thickness ratios of silver halide grains in a tabular silver halide emulsion. The term "diameter" refers to the diameter of a circle having a surface area equal to the projected surface area of a silver halide grain when the silver halide emulsion is observed by means of a microscope or an electron microscope. The term "thickness" refers to the distance between two parallel planes constituting the faces of tabular silver halide grain. Accordingly, a mean aspect ratio of 5:1 or more indicates that the diameter of the above-defined circle is 5 times the thickness of the grain.

In the tabular silver halide emulsion of the present invention, the tabular silver halide grains have a diameter about 5 times, preferably about 5 to 100 times, and more preferably about 5 to 50 times, the grain thickness. Further, the ratio of the projected surface area of the tabular silver halide grains to that of the total silver halide grains is 50% or more, preferably 70% or more, and more preferably 85% or more. By sing such grains, a silver halide photographic emulsion having excellent spectral sensitivity and exposure characteristics is obtained.

The individual tabular silver halide grains have a diameter ranging from about 0.5 to 10 μm, preferably about 0.6 to 5.0 μm, and more preferably about 1 to 4 μm and preferably have a thickness of about 0.2 μm or less.

In the present invention, a preferred tabular silver halide emulsion contains tabular silver halide grains having a diameter of about 0.6 to 5.0 μm and a thickness of about 0.2 μm or less and having a mean aspect ratio (mean diameter/mean thickness) of about 5 to 50 in a proportion of about 70% or more based on the total projected surface area of the total silver halide grains. A more preferred tabular silver halide emulsion contains tabular silver halide grains having a diameter of about 1.0 to 5.0 μm and a mean aspect ratio of about 8 to 50 in a proportion of about 85% or more based on the total projected surface area of the total silver halide grains.

The tabular silver halide grains which can be used in the present invention may be any of silver chloride, silver bromide, silver chlorobromide, silver iodobromide and silver chloroiodobromide, but preferred silver halides include silver bromide, silver iodobromide containing not more than about 12 mol% of silver iodide, silver chloroiodobromide containing not more than about 50 mol% of silver chloride and not more than about 2 mol% of silver iodide, and silver chlorobromide. The composition distribution in the mixed silver halide may either be homogeneous or heterogeneous, but homogeneous composition is preferable. The size distribution of the tabular silver halide grains may be either narrow or broad.

The tabular silver halide emulsions that can be used in the present invention are described in reports of Cugnac, Chateau, Duffin, *Photographic Emulsion Chemistry*, 66–72 (Focal Press, New York 1966) or A. P. H. Trivelli and W. F. Smith (eds.), *Photo. Journal*, 80, 285 (1940), and can be easily be prepared by the methods disclosed in Japanese Patent Application OPI Nos. 113927/83, 113928/83 and 127921/83 (the term "OPI" as used herein, refers to a "published, unexamined Japanese Patent Application").

For example, the tabular silver halide grains can be obtained by forming seed crystals containing 40 wt% or more of tabular grains in an atmosphere having a pBr of not more than 1.3 and a relatively high pAg value and adding silver and a halogen solution simultaneously while maintaining the pBr value approximately at the above level thereby growing the seed crystals. It is desirable to add silver and a halogen solution in the course of grain growth so as to prevent formation of new crystal nuclei.

The grain size of the tabular silver halide grains can be adjusted by controlling temperatures, kinds or amounts of solvents used, rates of addition of silver salts and the halide during grain growth, and the like, as disclosed in the above publications.

In the production of the tabular silver halide grains of this invention, the grain size, forms of grains (e.g., diameter/thickness ratio, etc.), the distribution of grain size or the growth rate of grains can be controlled, if desired, by using a solvent for silver halides. The amount of the solvent to be used is in the range of from about $10^{-3}$ to 10 wt%, and preferably from about $10^{-2}$ to $10^{-1}$ wt%, based on the reaction solution. As the amount of the solvent increases, the grain size distribution narrows and grain growth can be accelerated, but on the other hand the thickness of the grains tends to increase.

Known solvents for silver halides can be used in the present invention, such as ammonia, thioethers and thioureas. Thioether solvents are disclosed in U.S. Pat. Nos. 3,271,157, 3,574,628 and 3,790,387.

In the formation or physical ripening of silver halide grains, cadmium salts, zinc salts, lead salts, thallium salts, iridium salts or complexes thereof, iron salts or complexes thereof, and rhodium salts or complexes thereof, may be present.

In order to accelerate growth of grains during the formation of tabular silver halide grains which can be used in the present invention, it is advantageous to use a method of increasing the rates of addition, the amounts or the concentrations of a silver salt solution (e.g., $AgNO_3$ aqueous solution) and a halide solution (e.g., KBr aqueous solution), as specifically described in, for example, British Pat. No. 1,335,925, U.S. Pat. Nos.

3,650,757, 3,672,900 and 4,242,445, Japanese Patent Application OPI Nos. 142329/80 and 158124/80.

The tabular silver halide grains according to the present invention can be chemically sensitized if necessary. Chemical sensitization can be carried out by the methods described in, for example, H. Frieser (ed.), *Die Grundlagen der Photographischen Prozesse mit Silberhalogeniden*, 675–734 (Akademische Verlagsgesellschaft 1968).

More specifically, chemical sensitization can be achieved by sulfur sensitization using compounds containing sulfur reactive to active gelatin or silver (e.g., thiosulfates, thioureas, mercapto compounds and rhodanines), reduction sensitization using reducing substances (e.g., stannous salts, amines, hydrazine derivatives, formamidinesulfinic acid and silane compounds) or noble metal sensitization using noble metal compounds (e.g., gold comples salts, complex salts of Periodic Table Group VIII metals such as Pt, Ir, and Pd), or a combination of these techniques.

Specific examples of sulfur sensitization are described in U.S. Pat. Nos. 1,574,994, 2,278,947, 2,410,689, 2,728,668 and 3,656,955; specific examples of reduction sensitization are described in U.S. Pat. Nos. 2,419,974, 2,983,609 and 4,054,458; and noble metal sensitization is described in U.S. Pat. Nos. 2,399,083 and 2,448,060 and British Pat. No. 618,061.

Gold sensitization or sulfur sensitization or a combination thereof is preferred for the tabular silver halide grains of the present invention from the standpoint of saving silver.

In the above-described formulae (Ib), (IIb) and (IIIb), the alkyl, alkenyl or aralkyl group as represented by $R_{11}$, $R_{12}$, $R_{21}$, $R_{22}$, $R_{31}$ and $R_{32}$ contains not more than 10, preferably not more than 6, carbon atoms in its alkyl or alkylene moiety, and at least one of $R_{11}$ and $R_{12}$, at least one of $R_{21}$ and $R_{22}$, and at least one of $R_{31}$ and $R_{32}$ is an alkyl group substituted with a carboxyl group or a sulfo group.

Specific examples of the groups represented by $R_{11}$, $R_{12}$, $R_{21}$, $R_{22}$, $R_{31}$ or $R_{32}$ are methyl, ethyl, propyl, butyl, isopropyl, pentyl, hexyl, octyl, dodecyl, 2-hydroxyethyl, 3-hydroxypropyl, 2-(2-hydroxyethoxy)ethyl, carboxymethyl, 2-carboxyethyl, 3-carboxypropyl, ethoxycarbonylmethyl, 2-sulfoethyl, 3-sulfopropyl, 3-sulfobutyl, 4-sulfobutyl, 2-hydroxy-3-sulfopropyl, 2-chloro-3-sulfopropyl, 2-(3-sulfopropyloxy)ethyl, 2-sulfatoethyl, 3-sulfatopropyl, 3-thiosulfatopropyl, 2-phosphonoethyl, 2-chloroethyl, 2,2,2-trifluoroethyl, 2,2,3,3-tetrafluoropropyl, 2-cyanoethyl, 3-cyanoethyl, 2-carbamoylethyl, 3-carbamoylpropyl, cyclohexyl, cyclohexylmethyl, 2-furfurylmethyl, methoxyethyl, ethoxyethyl, methoxypropyl, allyl, benzyl, phenethyl, p-sulfophenethyl, m-sulfophenethyl and p-carboxyphenethyl.

Preferred sensitizing dyes represented by the formulae (Ib), (IIb) and (IIIb), are represented by the following formulae (Ia), (IIa) and (IIIa):

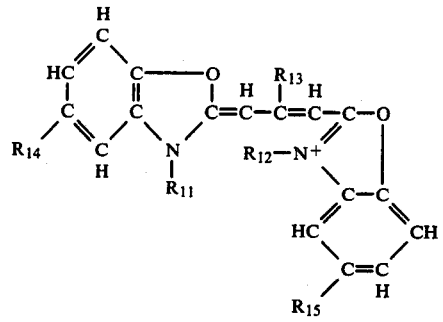

(Ia)

wherein $R_{11}$, $R_{12}$ and $R_{13}$ are as defined above,

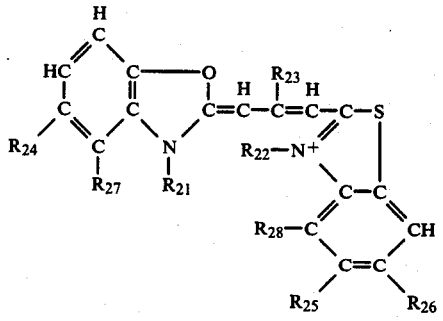

(IIa)

wherein $R_{21}$, $R_{22}$ and $R_{23}$ are as defined above,

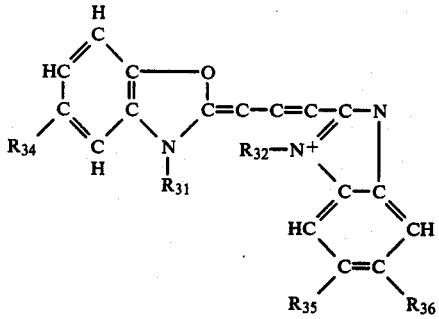

(IIIa)

wherein $R_{31}$ and $R_{32}$ are as defined above.

In the above-described formulae (Ia), (IIa) and (IIIa), $R_{14}$, $R_{15}$, $R_{24}$, $R_{25}$, $R_{26}$ and $R_{34}$, which may be the same or different, each represents a hydrogen atom, a hydroxy group, a halogen atom (e.g., a fluorine atom, a chlorine atom or a bromide atom), a substituted or unsubstituted alkyl group (e.g., methyl, ethyl, propyl, isopropyl, decyl, dodecyl, hydroxyethyl, carboxymethyl, ethoxycarbonylmethyl, trifluoromethyl, chloroethyl or methoxymethyl and preferably an alkyl group having 1 to 12, and more preferably 1 to 5, carbon atoms), a substituted of unsubstituted aryl group (e.g., phenyl, tolyl, anisyl, chlorophenyl, 1-naphthyl, 2-naphthyl, carboxyphenyl, 2-thienyl, 2-furyl or 2-pyridyl), an aralkyl group (e.g., benzyl, phenethyl or 2-furylmethyl), an alkoxy group (e.g., methoxy, ethoxy, butoxy or decyloxy, and preferably an alkoxy group having 1 to 10, and more preferably 1 to 5, carbon atoms), a carboxyl group, an alkoxycarbonyl group (e.g., methoxycarbonyl, ethoxycarbonyl or butoxycarbonyl, and preferably an alkoxycarbonyl group having 1 to 5 carbon atoms in its alkyl moiety) or an acylamino group (e.g., acetylamino, propionylamino or benzoylamino); $R_{27}$ represents a hydrogen atom or an atomic group necessary to form a benzene ring together with $R_{24}$; $R_{28}$ represents a hydrogen atom or an atomic group necessary to form a benzene ring together with $R_{25}$; $R_{35}$ represents a cyano group, an acyl group (e.g., acetyl, propionyl or benzoyl), an alkylsulfonyl group (e.g., methylsulfonyl or ethylsulfonyl), an alkylsulfinyl group (e.g., methylsulfinyl of ethylsulfinyl), an alkoxycarbonyl group (preferably, an alkoxycarbonyl group having 1 to 5 carbon atoms in its alkyl moiety, e.g., methoxycarbonyl or ethoxycarbonyl), a trifluoromethyl group or a halogen atom (e.g., fluorine or chlorine); and $R_{36}$ represents a hydrogen atom or a chlorine atom.

In the above-described formulae (Ia) to (IIIa), when the heterocyclic ring contained therein is a 2-pyrazolon-5-one ring or a 2-isoxazolin-5-one ring, the 3-position thereof may be substituted. Preferred substituents for these heterocyclic rings include an alkyl group (preferably, having 1 to 5 carbon atoms, e.g., methyl, ethyl, propyl or butyl), a phenyl group and a substituted phenyl group (e.g., tolyl, anisyl or chlorophenyl).

The sensitizing dyes used in the present invention are known compounds as disclosed in U.S. Pat. No. 4,326,813 and can be easily synthesized by a known method according to the procedure as described in the references cited in, for example, F. M. Homes, *The Cyanine Dyes and Related Compounds,* Interscience Publishers, New York (1964) and *Research Disclosure,* Vol. 176, page 23, Paragraph IV (RD-17643, December 1978).

Specific examples of the sensitizing dyes represented by the above-described formulae (Ia), (IIa) and (IIIa) are shown below, although the present invention is not to be construed as being limited thereto.

Sensitizing Dye (Ia)

Ia-1

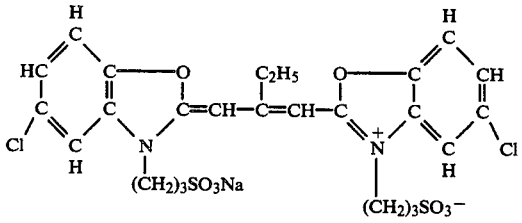

Ia-2

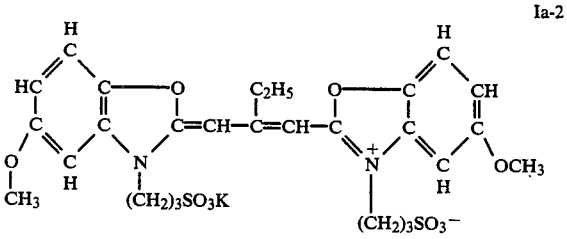

-continued

Ia-3

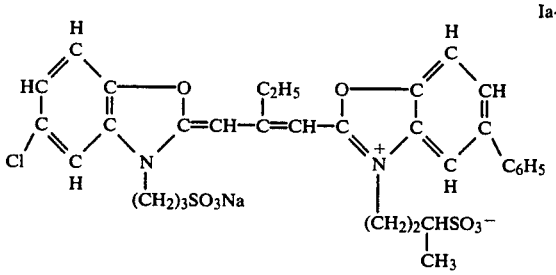

Ia-4

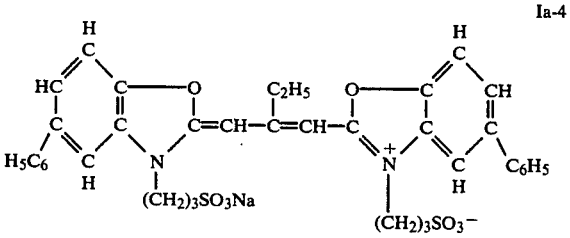

Ia-5

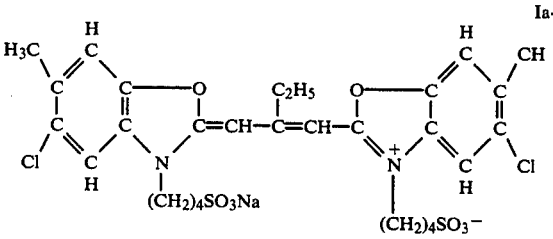

Ia-6

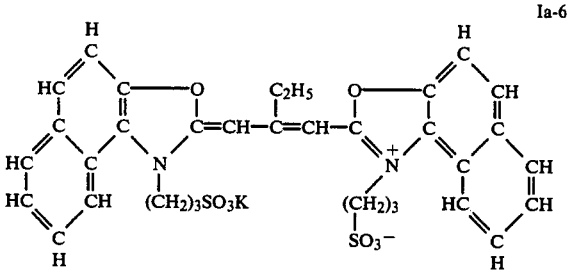

Sensitizing Dye (IIa)

IIa-1

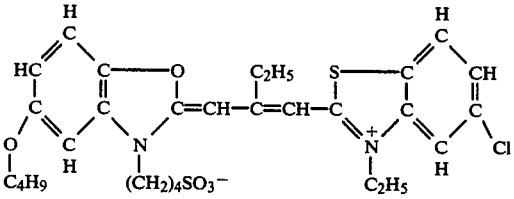

IIa-2

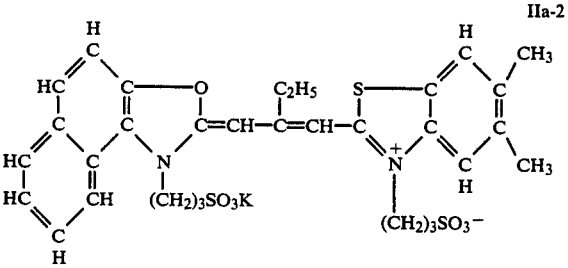

-continued

IIa-3

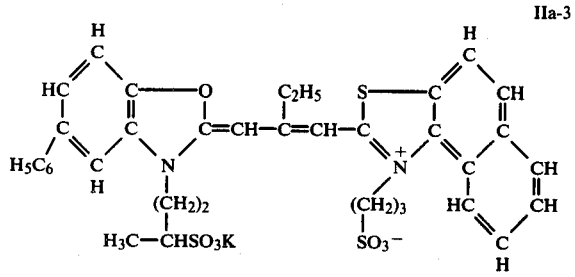

IIa-4

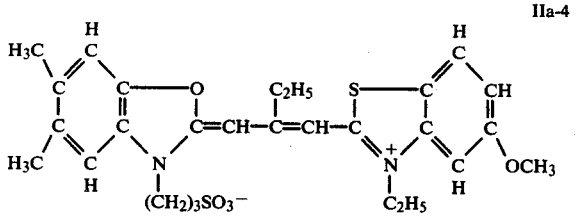

IIa-5

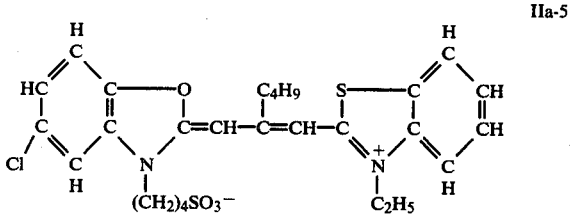

Sensitizing Dye (IIIa)

IIIa-1

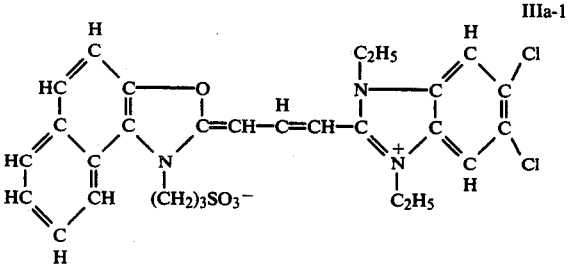

IIIa-2

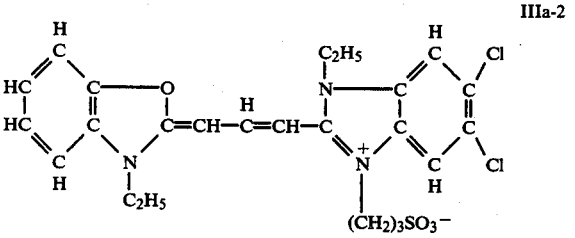

IIIa-3

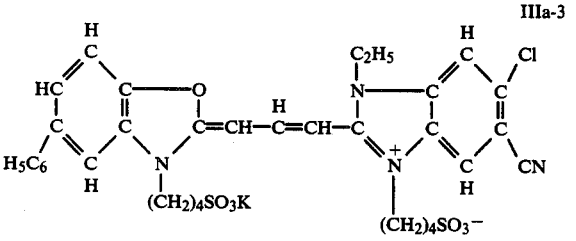

-continued

IIIa-4

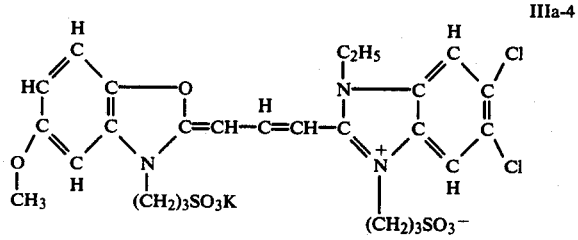

The sensitizing dyes of the formulae (Ib), (IIb) and (IIIb) are added to the tabular silver halide emulsion in amounts ranging from about $1\times10^{-6}$ to $5\times10^{-3}$ mol, and preferably about $1\times10^{-5}$ to $2.5\times10^{-3}$ mol, per mol of silver.

The combination of the sensitizing dyes which can be used in the present invention essentially comprises at least one sensitizing dye of formula (Ib) and at least one sensitizing dye selected from the sensitizing dyes of formulae (IIb) and (IIIb). A combination of at least one each of the sensitizing dyes (Ib), (IIb) and (IIIb) is particularly preferred for accomplishing a noticeable improvement in color reproducibility of color images.

The proportion of sensitizing dye (IIb) to sensitizing dye (Ib) is about 0.01 to 0.5 mol, more preferably about 0.05 to 0.3 mol, per mol of sensitizing dye (Ib), and the ratio of sensitizing dye (IIIb) to sensitizing dye (Ib) is about 0.1 to 1.0 mol, more preferably 0.2 to 0.5 mol, per mol of sensitizing dye (Ib). The molar proportion of sensitizing dye (IIb)/sensitizing (IIIb) is not limited, but is preferably 1/100 to 50/1.

The dyes (Ib), (IIb) and (IIIb) according to the present invention can be dispersed directly in an emulsion, or these dyes can be first dissolved in an appropriate solvent, such as methyl alcohol, ethyl alcohol, methyl cellosolve, acetone, water, pyridine or a mixture thereof and then added to an emulsion. Ultrasonic waves can be applied to dissolve the dyes in these solvents. Further, incorporation of the sensitizing dyes into an emulsion can be carried out by various methods, such as by dissolving dyes in an organic volatile solvent, dispersing the solution in a hydrophilic colloid and adding the dispersion to an emulsion as described in U.S. Pat. No. 3,469,987; by dispersing water-insoluble dyes in an aqueous solvent and adding the dispersion to an emulsion as described in Japanese Patent Publication No. 24185/71; by dissolving dyes in a surface active agent and adding the solution to an emulsion as described in U.S. Pat. No. 3,822,135; by dissolving dyes using a compound that causes red shift and adding the solution to an emulsion as described in Japanese Patent Application (OPI) No. 74624/76; or by dissolving dyes in an acid substantially free from water and adding the solution to an emulsion as described in Japanese Patent Application (OPI) No. 80826/75. In addition, the methods described in U.S. Pat. Nos. 2,912,343, 2,996,287, 3,342,605 and 3,429,835 can be used for incorporation of dyes in an emulsion. the above-described dyes may be uniformly dispersed in a silver halide emulsion before its application on an appropriate support, but the dyes may also be dispersed at any stage during the preparation of the silver halide emulsion.

Incorporation of couplers which can be used in the photographic light-sensitive materials according to the present invention into a silver halide emulsion layer can be achieved by any known method, such as the method described in U.S. Pat. No. 2,322,027. For example, the couplers can be dissolved in a high-boiling organic solvent, such as alkyl phthalates (e.g., dibutyl phthalate, dioctyl phthalate), phosphates (e.g., diphenyl phosphate, triphenyl phosphate, tricresyl phosphate, dioctylbutyl phosphate), citrates (e.g., tributylacetyl citrate), benzoates (e.g., octyl benzoate), alkylamides (e.g., diethyllaurylamide), fatty acid esters (e.g., dibutoxyethyl succinate, dioctyl azelate) and trimesates (e.g., tributyl trimesate), or a low-boiling organic solvent having a boiling point of about 30° to 150° C., such as lower alkyl acetates (e.g., ethyl acetate, butyl acetate), ethyl propionate, sec-butyl alcohol, methyl isobutyl ketone, β-ethoxyethyl acetate and methyl cellulose acetate, or a mixture of these high-boiling organic solvents and low-boiling organic solvents. The resulting solution is then dispersed in a hydrophilic colloid. A dispersion method using a polymer as disclosed in Japanese Patent Publication No. 39853/76 and Japanese Patent Application (OPI) No. 59943/76 can also be employed.

When the coupler has an acid group such as a carboxyl group or a sulfo group, it is incorporated in a hydrophilic colloid in the form of an alkaline aqueous solution.

Binders or protective colloids which can be used in the photographic emulsions can include gelatin as well as other conventional hydrophilic colloids.

For example, usable hydrophilic colloids other than gelatin include proteins such as gelatin derivatives, graft polymers obtained by grafting other high polymers onto gelatin, albumin and casein; cellulose derivatives such as hydroxyethyl cellulose, carboxymethyl cellulose and cellulose sulfates; sugar derivatives such as sodium alginate and starch derivatives; and various synthetic hydrophilic high molecular weight substances such as polyvinyl alcohol, partially acetylated polyvinyl alcohol, poly-N-vinylpyrrolidone, polyacrylic acid, polymethacrylic acid, polyacrylamide, polyvinylimidazole and polyvinylpyrazole and copolymers comprising the monomer units constituting these polymers.

The gelatin can include not only lime-processed gelatin but also acid-processed gelatin, enzyme-processed gelatin as described in *Bull. Soc. Sci. Phot. Japan,* No. 16, p. 30 (1966) and hydrolysis products and enzymatic decomposition products of gelatin.

The gelatin derivatives which can be used include those obtained by reacting gelatin with various compounds such as acid halides, acid anhydrides, isocyanates, bromoacetic acid, alkanesultones and vinylepoxy compounds. Specific examples of the gelatin derivatives are given in U.S. Pat. Nos. 2,614,928, 3,132,945, 3,186,846 and 3,312,553, British Pat. Nos. 861,414, 1,005,784 and 1,033,189 and Japanese Patent Publication No. 26845/67.

The gelatin graft polymers include graft polymers formed by grafting homo- or copolymer of a vinyl monomer or monomers such as acrylic acid, methacrylic acid or derivatives thereof (e.g., esters or amides), acrylonitrile or styrene to gelatin. In particular, graft polymers formed by grafting a polymer having a compatibility with gelatin to some extent, such as polymers of acrylic acid, methacrylic acid, acrylamide, methacrylamide and hydroxyalkyl methacrylates, to gelatin are preferred. Examples of these gelatin graft polymers are given in U.S. Pat. Nos. 2,763,625, 2,831,767 and 2,956,884.

Typical examples of synthetic hydrophilic high molecular weight substances are described in West German Patent Application (OLS) No. 2,312,708, U.S. Pat. Nos. 3,620,751 and 3,879,205 and Japanese Patent Publication No. 7561/68.

Silver halides which can be present in photographic emulsion layers of photographic light-sensitive materials according to the present invention include silver bromide, silver iodobromide, silver iodochlorobromide, silver chlorobromide and silver chloride, with silver iodobromide containing about 15 mol% or less of iodide being preferred. Especially preferred ones are silver iodobromides containing about 2 to 12 mol% of silver iodide.

The mean grain size of silver halide grains in the photographic emulsions (the grain size being defined as grain diameter if the grain has a spherical or a nearly spherical form and as the length of the edge if the grain has a cubic form, and being averaged based on projected areas of the grains) is not particularly restricted, but is preferably about 3 μm or less.

Grain size distribution may be either narrow or broad.

The silver halide grains in the photographic emulsions may have a regular crystal form such as a cube and an octahedron, an irregular crystal form such as a sphere or a plate, or a composite form thereof. The silver halide grains may also be a mixture of grains having different crystal forms.

The individual silver halide grains may comprise a core and an outer shell or may be homogeneous. In addition, they may have a surface where a latent image is formed to an appreciable extent, or may be grains where a latent image is predominantly formed in the interior thereof.

Photographic emulsions employed in the present invention can be prepared according to conventional methods as described in P. Glafkides, *Chimie et Physique Photographique* (Paul Montel Paris 1967), G. f. Duffin, *Photographic Emulsion Chemistry* (The Focal Press, London 1966), and V. L. Zelikman, et al., *Making and Coating Photographic Emulsions* (The Focal Press, London 1964). For example, photographic emulsions can be prepared according to any of the acid process, the neutral process and the ammonia process. Methods for reacting a water-soluble silver salt with a water-soluble halide include the single jet method, the double jet method, and a combination thereof.

A method in which silver halide grains are produced in the presence of excess silver ions (the "reverse mixing method") can also be employed. Further, the "controlled double jet method", in which the pAg of the liquid phase in which silver halide grains are precipitated is maintained constant, may be used to produce silver halide emulsions in which grains have a regular crystal form and an almost uniform size distribution.

Two or more silver halide emulsions prepared separately may be employed in the form of a mixture.

In the process of producing silver halide grains or physically ripening the silver halide grains produced, cadmium salts, zinc salts, lead salts, thallium salts, iridium salts or complexes thereof, rhodium salts or complexes thereof, and iron salts or complexes thereof may be present.

Removal of soluble salts from the silver halide emulsion after the formation of silver halide grains or after physical ripening can be effected using the noodle washing method which comprises gelling the gelatin, or using a sedimentation process (causing flocculation in the emulsion) using an inorganic salt, an anionic surface active agent, an anionic polymer (e.g., polystyrenesulfonic acid) or a gelatin derivative (e.g., acylated gelatin or carbamoylated gelatin).

The silver halide emulsion is usually subjected to chemical sensitization. Chemical sensitization can be carried out by the processes as described in, for example, H. Frieser, *Die Gründlagen der Photographischen Prozesse mit Silberhalogeniden* 675–734 (Akademische Verlagsgesellschaft 1968).

More specifically, chemical sensitization can be carried out by sulfur sensitization using compounds containing sulfur capable of reacting with active gelatin or silver ions (e.g., thiosulfates, thioureas, mercapto compounds or rhodanines), reduction sensitization using reducing materials (e.g., stannous salts, amines, hydrazine derivatives, formamidinesulfinic acid or silane compounds), noble metal sensitization using noble metal compounds (e.g., gold complexes, and complexes of Periodic Table Group VIII metals such as Pt, Ir or Pd).

Specific examples of sulfur sensitization are described in U.S. Pat. Nos. 1,574,944, 2,278,947, 2,410,689, 2,728,668 and 3,656,955. Specific examples of reduction sensitization are described in U.S. Pat. Nos. 2,419,974, 2,983,609 and 4,054,458. Specific examples of noble metal sensitization are described in U.S. Pat. Nos. 2,399,083, 2,448,060 and British Pat. No. 618,061.

Photographic emulsions employed in the present invention can contain various conventional compounds for the purpose of preventing fog in preparation, storage of photographic processing, or for stabilizing photographic properties. Specific examples of such compounds include azoles such as benzothiazolium salts, nitroimidazoles, triazoles, benzotriazoles and benzimidazoles (especially those which are nitro- or halogen-substituted); heterocyclic mercapto compounds such as mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; the above-described heterocyclic mercapto compounds having water-soluble groups such as a carboxyl group, a sulfonyl group or the like; thioketo compounds such as oxazolinethione; azaindenes such as tetraazaindenes (particularly 4-hydroxy-substituted (1,3,3a,7)tetraazaindenes); benzenethiosulfonic acid; benzenesulfinic acids; and other conventional antifoggants or stabilizers.

Specific examples and usage of such compounds are disclosed in U.S. Pat. Nos. 3,954,474, 3,982,947 and 4,021,248 and Japanese Patent Publication No. 28660/77.

Photographic emulsions or other hydrophilic colloidal layers of the light-sensitive materials of the present invention may contain various surface active agents for a wide variety of purposes, for example, as a coating aid, or for prevention of static charge, improvement in a slipping property, emulsifying dispersions, prevention of adhesion and improvement in photographic properties (e.g., development acceleration or increase in contast and sensitivity.

Specific examples of the surface active agents that can be used include nonionic surface active agents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitol esters, polyalkylene glycol alkylamines, polyalkylene glycol alkylamides and polyethylene oxide adducts of silicone), glycidol derivatives (e.g., alkenylsuccinic polyglycerides and alkylphenyl polyglycerides), fatty acid esters of polyhydric alcohols and alkyl esters of sugars; anionic surface active agents containing acidic groups such as carboxyl, sulfo, phospho, sulfate, phosphate and like groups, e.g., alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers and polyoxyethylene alkylphosphates; amphoteric surface active agents such as amino acids, aminoalkylsulfonic acids, aminoalkyl sulfates or phosphates, alkylbetaines and amine oxides; and cationic surface active agents such as alkylamine salts, aliphatic or aromatic quaternary ammonium salts, heterocyclic quaternary ammonium salts, e.g., pyridinium and imidazolium, and aliphatic or heterocyclic phosphonium or sulfonium salts.

The photographic emulsions of the present invention may contain, for example, polyalkylene oxides and derivatives thereof such as ethers, esters and amines thereof, thioether compounds, thiomorpholines, quaternary ammonium salt compounds, urethane derivatives, urea derivatives, imidazole derivatives and 3-pyrazolidones in order to increase sensitivity and contrast, or in order to accelerate the developing rate. Examples of such compounds are disclosed in, for example, U.S. Pat. Nos. 2,400,532, 2,423,549, 2,716,062, 3,617,280, 3,772,021 and 3,808,003, and British Pat. No. 1,488,991.

The photographic emulsions or other hydrophilic colloidal layers of photographic light-sensitive materials used in the present invention can contain dispersions of water-insoluble or silightly soluble synthetic polymers for the purpose of improving dimensional stability and the like. Such polymers include those having, as monomer components, alkyl (meth)acrylate, alkoxyalkyl (meth)acrylate, glycidyl (meth)acrylate, (meth)acrylamide, vinyl esters (e.g., vinyl acetate), acrylonitrile, olefins and styrene, individually or in combinations of two or more thereof, or a combination of the above-described monomers and acrylic acid, methacrylic acid, an $\alpha,\beta$-unsaturated dicarboxylic acid, a hydroxyalkyl (meth)acrylate, a sulfoalkyl (meth)acrylate or styrenesulfonic acid. Specific examples of these polymers are described in U.S. Pat. Nos. 2,376,005, 2,739,137, 2,853,457, 3,062,674, 3,411,911, 3,488,708, 3,525,620, 3,607,290, 3,635,715 and 3,645,740, and British Pat. Nos. 1,186,699 and 1,307,373.

Conventional methods and processing solutions, such as described in *Research Disclosure,* No. 176, 28–30 (RD-17643) 1978, can be used for processing photographic emulsions prepared in accordance with the present invention. Any conventional photographic processing method, whether for the formation of silver images (monochromatic photographic processing) or for the formation of dye images (color photographic processing), can be used depending on the end use of the light-sensitive material. Processing temperatures are generally selected in the range of about 18° C. to 50° C., although temperatures lower than 18° C. and temperatures higher than 50° C. may also be employed.

In development processing, a method in which the developing agent is contained in the light-sensitive material, e.g., in an emulsion layer, and the sensitive material is treated in an aqueous alkaline solution to effect development may be employed. Developing agents which are hydrophobic can be incorporated in emulsion layers using various methods as described in, e.g., *Research Disclosure,* No. 169 (RD-16928), U.S. Pat. No. 2,739,890, British Pat. No. 813,253 and West German Pat. No. 1,547,763. Such development processing may be carried out in combination with silver salt stabilizing processing using a thiocyanate.

Any conventional fixing solution can be used, including fixing agents such as thiosulfates and thiocyanates as well as organic sulfur compounds which have a fixing effect. The fixing solution may contain water-soluble aluminum salts as a hardener.

Dye images can be formed using conventional methods, for example, the negative-positive method disclosed in *Journal of the Society of Motion Picture and Television Engineers,* Vol. 61, 667–701 (1953).

A color developing solution generally comprises an alkaline aqueous solution containing a color developing agent. Specific examples of color developing agents include known aromatic primary amine developers such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-β-hydroxyethylaniline, 3-methyl-4-amino-N-ethyl-N-β-methanesulfoamidoethylaniline and 4-amino-3-methyl-N-ethyl-N-β-methoxyethylaniline).

In addition to these developing agents, those described in L. F. A. Mason, *Photographic Processing Chemistry,* pp. 226–229, (Focal Press, London 1966), U.S. Pat. Nos. 2,193,015 and 2,592,364, and Japanese Patent Application (OPI) No. 64933/73 may also be employed.

The color developing solution can additionally contain a pH buffer, a development inhibitor and an antifoggant as well as other conventional additives. Optionally, it may contain a water softener, a preservative, an organic solvent, a development accelerator, dye forming couplers, competing couplers, a fogging agent, an assistant developer, a viscosity-imparting agent, a polycarboxylic acid series chelating agent, an antioxidant and the like. Specific examples of these additives are described in *Research Disclosure* (RD-17643), U.S. Pat. No. 4,083,723 and West German Patent Application (OLS) No. 2,622,950.

After color development, the photographic emulsion is usually subjected to bleaching. Bleaching may be carried out simultaneously with fixing, or these two processes may be carried out separately. Examples of bleaching agents that can be used include compounds of polyvalent metals, such as Fe (III), Co (III), Cr (VI) and Cu (II), peroxy acids, quinones, nitroso compounds and the like. More specifically, bleaching agents include ferricyanides; bichromates; complex salts formed by Fe (III) or Co (III) and aminopolycarboxylic acids, such as ethylenediaminetetraacetic acid, nitrilotriacetic acid, and 1,3-diamino-2-propanol tetraacetic acid, or organic acids, such as citric acid, tartaric acid and malic acid; persulfates and permanganates; and nitrosophenol. Among these agents, potassium ferricyanide, sodium (ethylenediaminetetraacetato)ferrate (III) and ammonium (ethylenediaminetetraacetato)ferrate (III) are particularly useful. The (ethylenediaminetetraacetato)iron (III) complexes are useful both in an independent bleaching solution and in a combined bleach-fix bath.

The bleaching or the bleach-fix bath can contain a bleach accelerating agent as described in U.S. Pat. Nos. 3,041,520 and 3,241,966, and Japanese Patent Publication Nos. 8506/70 and 8896/70; thiol compounds as described in Japanese Patent Application (OPI) No. 65732/78; and other conventional additives.

Photographic emulsions used in the present invention may be spectrally sensitized with methine dyes and other sensitizing dyes including cyanine dyes, merocyanine dyes, complex cyanine dyes, complex merocyanine dyes, holopolar cyanine dyes, hemicyanine dyes, styryl dyes and hemioxonol dyes. Cyanine dyes, merocyanine dyes and complex merocyanine dyes are particularly useful.

Examples of useful sensitizing dyes are described in German Pat. No. 929,080, U.S. Pat. Nos. 2,493,748, 2,503,776, 2,519,001, 2,912,329, 3,656,959, 3,672,897 and 4,025,349, British Pat. No. 1,242,588 and Japanese Patent Publication No. 14030/69.

These sensitizing dyes may be used alone or in combination of two or more. Combinations of sensitizing dyes are frequently employed for the purpose of super-sensitization. Typical examples of super-sensitizing combinations are given in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/78 and Japanese Patent Application (OPI) Nos. 109925/77 and 110618/77.

The present invention can be applied to a multilayer multicolor photographic material comprising a support having provided thereon at least two layers having different spectral sensitivities. A multilayer color photographic material usually has at least one red-sensitive emulsion layer, at least one green-sensitive emulsion layer and at least one blue-sensitive emulsion layer on a support. The order of these layers can be arbitrarily selected. It is conventional to incorporate a cyan forming coupler in a red-sensitive emulsion layer, a magenta forming coupler in a green-sensitive emulsion layer, and a yellow forming coupler in a blue-sensitive emulsion layer, respectively, although different combinations may be used in some cases.

In the photographic emulsion layers of the photographic light-sensitive materials prepared in accordance with the present invention, color forming couplers, i.e., compounds capable of forming colors by oxidative coupling with aromatic primary amine developers (e.g., phenylenediamine derivatives and aminophenol derivatives) in color development processing, may be used in combination with a polymer coupler latex, or may be used alone in layers without a polymer coupler latex. Examples of magenta couplers which can be used include 5-pyrazolone couplers, pyrazolobenzimidazole couplers, cyanoacetylcoumarone couplers and open-chain acylacetonitrile couplers. Examples of yellow couplers which can be used include acylacetamide couplers (e.g., benzoyl acetanilides and pivaloyl acetanilides). Examples of cyan couplers which can be used include naphthol couplers and phenol couplers. It is desirable that these couplers contain hydrophobic groups called ballast groups by which they are rendered non-diffusible. These couplers may be either 4-equivalent or 2-equivalent with respect to silver ions. Moreover, they may be colored couplers having a color correcting effect, or couplers capable of releasing development inhibitors with the progress of development ("DIR couplers"). In addition to DIR couplers, colorless DIR coupling compounds which yield colorless products upon coupling and release development inhibitors may be used.

Preferred couplers include 2-equivalent couplers and magenta color forming 2-equivalent couplers are particularly preferred.

Specific examples of the magenta color forming couplers which can be used are disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65 and Japanese Patent Application (OPI) Nos. 74027/74, 74028/74, 129538/74, 60233/75, 159336/75, 20826/76, 26541/76, 42121/77, 58922/77 and 55122/78.

Specific examples of the yellow color forming couplers which can be used are described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76 and Japanese Patent Application (OPI) Nos. 26133/72, 73147/73, 6341/75, 87650/75, 123342/75, 130442/75, 21827/76, 102636/76, 82424/77 and 115219/77.

Specific examples of the cyan color forming couplers which can be used are given in U.S. Pat. Nos. 2,369,929, 2,434,272, 2,474,293, 2,521,908, 2,895,826, 3,034,892, 3,311,476, 3,458,315, 3,476,563, 3,583,971, 3,591,382, 3,767,411 and 4,004,929, West German Patent Application (OLS) Nos. 2,414,830 and 2,454,329 and Japanese Patent Application (OPI) Nos. 5055/73, 59838/73, 26034/76, 146828/76, 69624/77 and 90932/77.

Specific examples of the colored couplers which can be used in the present invention are described in, for example, U.S. Pat. Nos. 2,521,908, 3,034,892 and 3,476,560, Japanese Patent Publication Nos. 22335/63, 11304/67, 2016/69 and 32461/69, Japanese Patent Application (OPI) Nos. 26034/76 and 42121/77 and West German Patent Application (OLS) No. 2,418,959.

Specific examples of the DIR couplers which can be used in the present invention are described in, for example, U.S. Pat. Nos. 3,227,554, 3,617,291, 3,632,345, 3,701,783 and 3,790,384, West German Patent Application (OLS) Nos. 2,414,006, 2,454,301 and 2,454,329, British Pat. No. 953,454, Japanese Patent Application (OPI) Nos. 122335/74 and 69624/77 and Japanese Patent Publication No. 16141/76.

In addition to the DIR couplers, compounds capable of releasing development inhibitors with the progress of development can be incorporated in the light-sensitive materials. Specific examples of such compounds are described in, for example, U.S. Pat. Nos. 3,297,445 and 3,379,529, West German Patent Application (OLS) No. 2,417,914 and Japanese Patent Application (OPI) Nos. 15271/77 and 9116/78.

In the photographic light-sensitive materials according to the present invention, the photographic emulsion layers and other hydrophilic colloidal layers can contain inorganic or organic hardeners. The hardeners which can be used include chromium salts (e.g., chromium alum and chromium acetate), aldehydes (e.g., formaldehyde, glyoxal and glutaraldehyde), N-methylol compounds (e.g., dimethylolurea, and methyloldimethylhydantoin), dioxane derivatives (e.g., 2,3-dihydroxydioxane), active vinyl compounds (e.g., 1,3,5-triacryloylhexahydro-s-triazine, and 1,3-vinylsulfonyl-2-propanol), active halogen compounds (e.g., 2,4-dichloro-6-hydroxy-s-triazine), and mucohalogenides (e.g., mucochloric acid and mucophenoxychloric acid). Such hardeners may be used alone or in a combination of two or more.

If the hydrophilic colloidal layers of the photographic light-sensitive material of the present invention contain dyes or ultraviolet absorbents, they may be mordanted by cationic polymers such as those described in, for example, British Pat. No. 685,475, U.S. Pat. Nos. 2,675,316, 2,893,401, 2,882,156, 3,048,487, 3,184,309 and 3,445,231, West German Patent Application (OLS) No. 1,914,362. Japanese Patent Application (OPI) Nos. 47624/75 and 71332/75.

The photographic light-sensitive materials prepared in accordance with the present invention may contain a color fog preventing agent, such as a hydroquinone derivative, an aminophenol derivative, a gallic acid derivative or an ascorbic acid derivative.

The hydrophilic colloidal layers of the photographic light-sensitive materials in accordance with the present invention may contain ultraviolet absorbents, including benzotriazole compounds substituted with aryl groups, 4-thiazolidone compounds, benzophenone compounds, cinnamic acid esters, butadiene compounds, benzoxazole compounds, and, further, ultraviolet absorbing polymers. These ultraviolet absorbents may be fixed in the foregoing hydrophilic colloidal layers.

Specific examples of these ultraviolet absorbents are described in U.S. Pat. Nos. 3,314,794, 3,352,681, 3,499,762, 3,533,794, 3,700,455, 3,705,805, 3,707,375 and 4,045,229, Japanese Patent Application (OPI) No. 2784/71, and West German Patent Publication No. 1,547,863.

The hydrophilic colloidal layers of the silver halide color photographic light-sensitive materials according to the present invention may contain water-soluble dyes for various purposes, for example, as filter dyes or for prevention of irradiation. Such dyes include oxonol dyes, hemioxonol dyes, styryl dyes, merocyanine dyes, cyanine dyes and azo dyes. Of these, oxonol dyes, hemioxonol dyes and merocyanine dyes are particularly useful.

In carrying out the present invention, discoloration inhibitors can be used and, further, color image stabilizing agents can also be used individually or in combination of two or more. Examples of known discoloration inhibitors include hydroquinone derivatives disclosed in U.S. Pat. Nos. 2,360,290, 2,418,613, 2,675,314, 2,701,197, 2,704,713, 2,710,801, 2,728,659, 2,732,300, 2,735,765 and 2,816,028, and British Pat. No. 1,363,921; gallic acid derivatives disclosed in U.S. Pat. Nos. 3,069,262 and 3,457,079; p-alkoxyphenols disclosed in U.S. Pat. Nos. 2,735,765 and 3,698,909 and Japanese Patent Publication Nos. 20977/74 and 6623/77; p-oxyphenol derivatives disclosed in U.S. Pat. Nos. 3,432,300, 3,573,050, 3,574,627 and 3,764,337 and Japanese Patent Application (OPI) Nos. 38633/77, 14734/77 and 152225/77; and bisphenols disclosed in U.S. Pat. No. 3,700,455.

Photographic supports which can be used in the present invention are those commonly employed in photographic light-sensitive materials, such as cellulose nitrate film, cellulose acetate film, cellulose acetate butyrate film, cellulose acetate propionate film, polystyrene film, polyethylene terephthalate film, polycarbonate film or laminates of these films, thin glass, paper and the like. Good results can be obtained by using a paper support coated or laminated with baryta or an α-olefin polymer, particularly a polymer of an α-olefin having 2 to 10 carbon atoms, e.g., polyethylene, polypropylene and ethylene-butene copolymer, or plastic film supports having a roughened surface which improves adhesiveness to other high polymeric substances as shown in Japanese Patent Publication No. 19068/72. The supports may be colored with dyes or pigments. Further, they may be rendered black for the purpose of shielding light. The surfaces of these supports are generally subjected to a subbing treatment to improve the adhesiveness to photographic emulsion layers. Before or after the subbing treatment, the surfaces of the supports may be subjected to corona discharge treatment, ultraviolet irradiation treatment or flame treatment.

The photographic emulsion layers and other hydrophilic colloidal layers of the photographic light-sensitive materials of the present invention may contain fluorescent brightening agents including stilbenes, triazines, oxazoles and coumarines. These may be either water-soluble or water-insoluble, and if water-insoluble they can be used in the form of a dispersion.

The photographic light-sensitive material in accordance with the present invention may contain a color fog preventing agent, such as hydroquinone derivative, an aminophenol derivative, a gallic acid derivative or an ascorbic acid derivative.

Suitable exposure times which can be used for the silver halide color photographic light-sensitive materials prepared according to the present invention include not only exposure times commonly obtained with cameras ranging from about 1/1,000 to about 1 second, but also exposure times shorter than 1/1,000 second, e.g., about $1/10^4$ to about $1/10^6$ second obtained with xenon flash lamps and cathode ray tubes. Exposure times longer than 1 second can also be used. If necessary, the spectral composition of the light employed for the exposure can be controlled with color filters. Laser beams can also be used for exposure, as well as light emitted from phosphors excited by electron beams, X-rays, $\gamma$-rays or $\alpha$-rays.

Since the silver halide photographic light-sensitive material according to the present invention employs a combination of silver halide grains having a specific form and specific sensitizing dyes, undesirable latensification after exposure can be avoided while retaining the spectral sensitivity distribution obtained with conventional photographic light-sensitive materials. In particular, the commonly employed green sensitizing dye benzimidazole, which has been inapplicable to tabular form silver halide grains, now be used according to the present invention. Such consideration demonstrate the great significance of the present invention in the photographic field.

The present invention will now be illustrated in greater detail by the following specific examples, but it should be understood that these examples are not to be construed as limiting the present invention. Unless otherwise indicated, all parts percents and ratios are by weight.

EXAMPLE 1

A multilayer color photographic light-sensitive material was prepared by coating the following layers onto a cellulose triacetate film support. The resulting sample was designated as Sample 101.

First Layer (Antihalation Layer):

A gelatin layer containing 0.18 g/m$^2$ of black colloidal silver.

Second Layer (Intermediate Layer):

A gelatin layer containing the following components.

| | |
|---|---|
| 2,5-Di-t-pentadecylhydroquinone | 0.18 g/m$^2$ |
| Coupler C-3 | 0.11 g/m$^2$ |

Third Layer (First Red-Sensitive Emulsion Layer):

A gelatin layer containing the following components:

| | |
|---|---|
| Silver iodobromide emulsion (silver iodide content: 4 mol %; mean grain size: 0.4 μm) | 0.72 g/m$^2$ (calculated as Ag) |
| Sensitizing Dye A | $9.0 \times 10^{-5}$ mol per mol of Ag |
| Sensitizing Dye B | $3.0 \times 10^{-5}$ mol per mol of Ag |
| Sensitizing Dye C | $4.2 \times 10^{-4}$ mol per mole of Ag |
| Sensitizing Dye D | $3.0 \times 10^{-5}$ mol per mol of Ag |
| Coupler C-4 | 0.093 g/m$^2$ |
| Coupler C-5 | 0.31 g/m$^2$ |
| Coupler C-6 | 0.01 g/m$^2$ |

Fourth Layer (Second Red-Sensitive Emulsion Layer):

A gelatin layer containing the following components:

| | |
|---|---|
| Silver iodobromide emulsion (silver iodide content: 10 mol %; mean grain size: 1.0 μm) | 1.2 g/m$^2$ (calculated as Ag) |
| Sensitizing Dye A | $7.8 \times 10^{-5}$ mol per mol of Ag |
| Sensitizing Dye B | $2.2 \times 10^{-5}$ mol per mol of Ag |
| Sensitizing Dye C | $3.0 \times 10^{-4}$ mol per mol of Ag |
| Sensitizing Dye D | $2.2 \times 10^{-5}$ mol per mol of Ag |
| Coupler C-4 | 0.1 g/m$^2$ |
| Coupler C-5 | 0.061 g/m$^2$ |
| Coupler C-7 | 0.046 g/m$^2$ |

Fifth Layer (Third Red-Sensitive Emulsion Layer):

A gelatin layer containing the following components:

| | |
|---|---|
| Silver iodobromide emulsion (silver iodide content: 10 mol %; mean grain size: 1.5 μm) | 1.5 g/m$^2$ (calculated as Ag) |
| Sensitizing Dye A | $8.0 \times 10^{-5}$ mol per mol of Ag |
| Sensitizing Dye B | $2.4 \times 10^{-5}$ mol per mol of Ag |
| Sensitizing Dye C | $3.3 \times 10^{-5}$ mol per mol of Ag |
| Sensitizing Dye D | $2.4 \times 10^{-5}$ mol per mol of Ag |
| Coupler C-7 | 0.32 g/m$^2$ |
| Coupler C-17 | 0.001 g/m$^2$ |

Sixth Layer (Intermediate Layer):

A gelatin layer coated in an amount of 1 g/m$^2$.

Seventh Layer (First Green-Sensitive Emulsion Layer):

A gelatin layer containing the following components:

| | |
|---|---|
| Silver iodobromide emulsion | 0.55 g/m$^2$ |

-continued

| | |
|---|---|
| (silver iodide content: 5 mol %; mean grain size: 0.5 μm) | (calculated as Ag) |
| Sensitizing Dye I-7 | $3.8 \times 10^{-4}$ mol per mol of Ag |
| Sensitizing Dye E | $1.5 \times 10^{-4}$ mol per mol of Ag |
| Coupler C-8 | 0.29 g/m$^2$ |
| Coupler C-9 | 0.04 g/m$^2$ |
| Coupler C-10 | 0.055 g/m$^2$ |
| Coupler C-11 | 0.058 g/m$^2$ |

Eighth Layer (Second Green-Sensitive Emulsion Layer):

A gelatin layer containing the following components:

| | |
|---|---|
| Silver iodobromide emulsion (silver iodide content: 6 mol %; spherical grains having a mean grain size of 1.2 μm) | 1.0 g/m$^2$ (calculated as Ag) |
| Sensitizing Dye I-7 | $2.7 \times 10^{-4}$ mol per mol of Ag |
| Sensitizing Dye E | $1.1 \times 10^{-4}$ mol per mol of Ag |
| Coupler C-8 | 0.025 g/m$^2$ |
| Coupler C-9 | 0.013 g/m$^2$ |
| Coupler C-10 | 0.009 g/m$^2$ |
| Coupler C-11 | 0.011 g/m$^2$ |

Ninth Layer (Third Green-Sensitive Emulsion Layer):

A gelatin layer containing the following components:

| | |
|---|---|
| Silver iodobromide emulsion (silver iodide content: 8 mol %; spherical grains having a mean grain size of 1.8 μm) | 2.0 g/m$^2$ (calculated as Ag) |
| Sensitizing Dye I-7 | $3.0 \times 10^{-4}$ mol per mol of Ag |
| Sensitizing Dye E | $1.2 \times 10^{-4}$ mol per mol of Ag |
| Coupler C-9 | 0.008 g/m$^2$ |
| Coupler C-12 | 0.05 g/m$^2$ |
| Coupler C-18 | 0.001 g/m$^2$ |

Tenth Layer (Yellow Filter Layer):

A gelatin layer containing the following components:

| | |
|---|---|
| Yellow colloidal silver | 0.04 g/m$^2$ |
| 2,5-Di-t-pentadecylhydroquinone | 0.031 g/m$^2$ |

Eleventh Layer (First Blue-Sensitive Emulsion Layer):

A gelatin layer containing the following components:

| | |
|---|---|
| Silver iodobromide emulsion (silver iodide content: 5 mol %; mean grain size: 0.4 μm) | 0.32 g/m$^2$ (calculated as Ag) |
| Coupler C-13 | 0.68 g/m$^2$ |

-continued

| | |
|---|---|
| Coupler C-14 | 0.03 g/m$^2$ |

Twelfth Layer (Second Blue-Sensitive Emulsion Layer):

A gelatin layer containing the following components:

| | |
|---|---|
| Silver iodobromide emulsion (silver iodide content: 10 mol %; mean grain size: 1.0 μm) | 0.29 g/m$^2$ (calculated as Ag) |
| Sensitizing Dye F | $2.2 \times 10^{-4}$ mol per mol of Ag |
| Coupler C-13 | 0.22 g/m$^2$ |

Thirteenth Layer (Fine Grain Emulsion Layer):

A gelatin layer containing 0.4 g/m$^2$ (calculated as Ag) of a silver iodobromide emulsion (silver iodide content: 2 mol%; mean grain size: 0.15 μm).

Fourteenth Layer (Third Blue-Sensitive Emulsion Layer):

A gelatin layer containing the following components:

| | |
|---|---|
| Silver iodobromide emulsion (silver iodide content: 14 mol %; mean grain size: 2.3 μm) | 0.79 g/m$^2$ (calculated as Ag) |
| Sensitizing Dye F | $2.3 \times 10^{-4}$ mol per mol of Ag |
| Coupler C-13 | 0.19 g/m$^2$ |
| Coupler C-15 | 0.001 g/m$^2$ |

Fifteenth Layer (First Protective Layer):

A gelatin layer containing the following components:

| | |
|---|---|
| Ultraviolet Absorbent C-1 | 0.14 g/m$^2$ |
| Ultraviolet Absorbent C-2 | 0.22 g/m$^2$ |

Sixteenth Layer (Second Protective Layer):

A gelatin layer containing the following components:

| | |
|---|---|
| Polymethyl methacrylate particles (diameter: 1.5 μm) | 0.05 g/m$^2$ |
| Silver iodobromide emulsion (silver iodide content: 2 mol %; mean grain size: 0.07 μm) | 0.3 g/m$^2$ (calculated as Ag) |

In each of the layers was added gelatin hardener C-16 and a surface active agent having the following formula in addition to the above-described components.

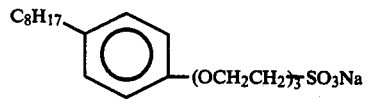

The compounds used in preparing samples are shown below.

a polymer of formula

-continued
C-1
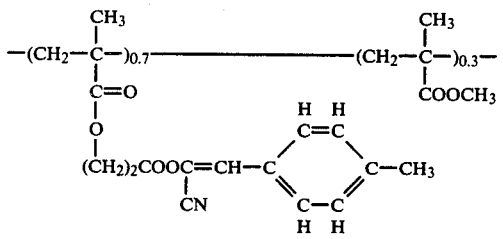
(molecular weight, about 20,000)
C-2
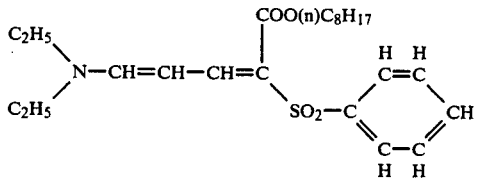
C-3
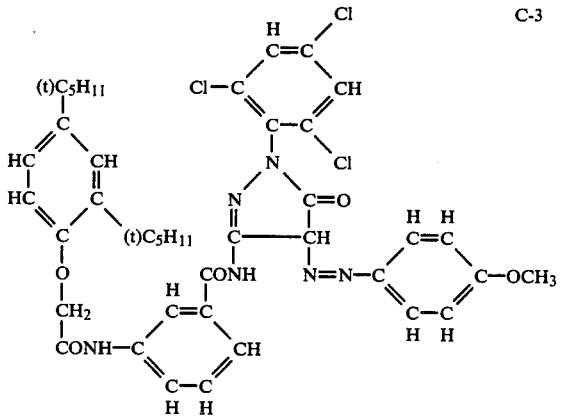
C-4
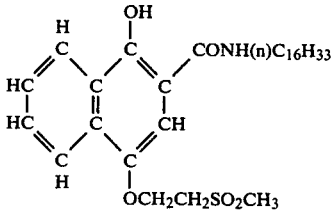
C-5
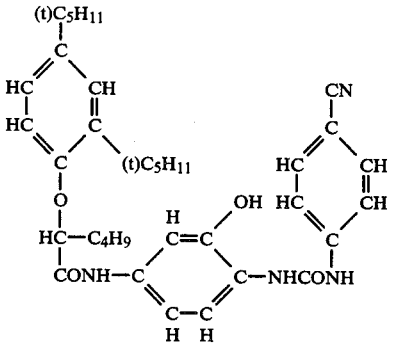
C-6
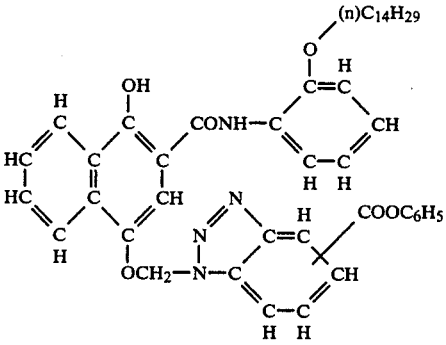
a polymer of formula
C-7
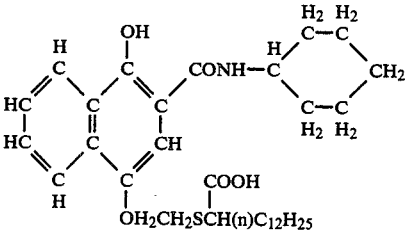
C-8
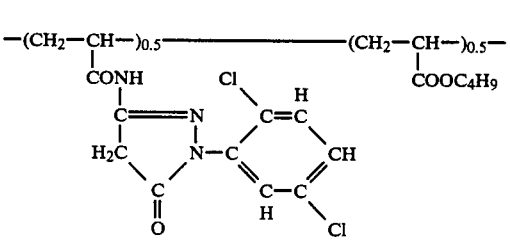
(molecular weight, about 20,000)

-continued
C-9
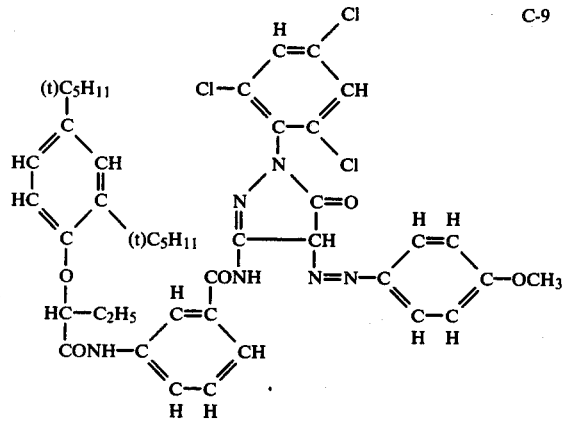
C-10
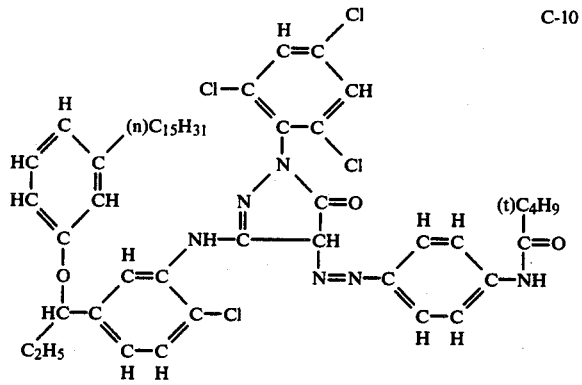
C-11
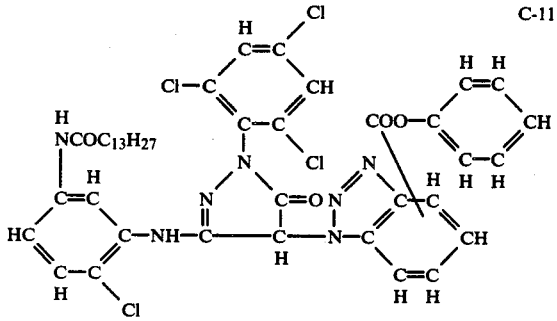
C-12
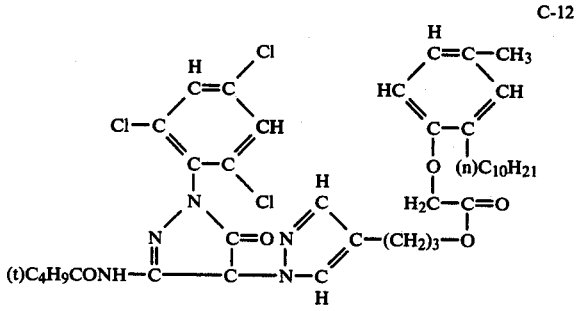
C-13
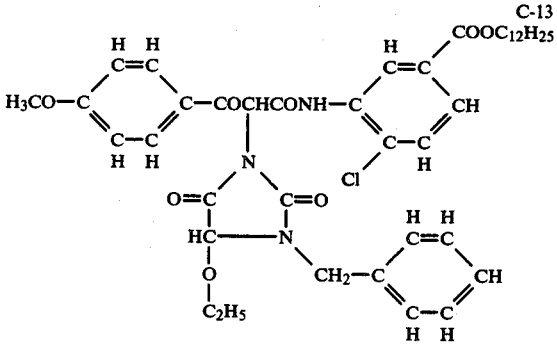
C-14
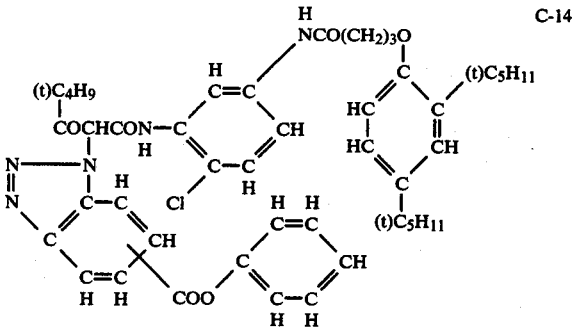
C-15
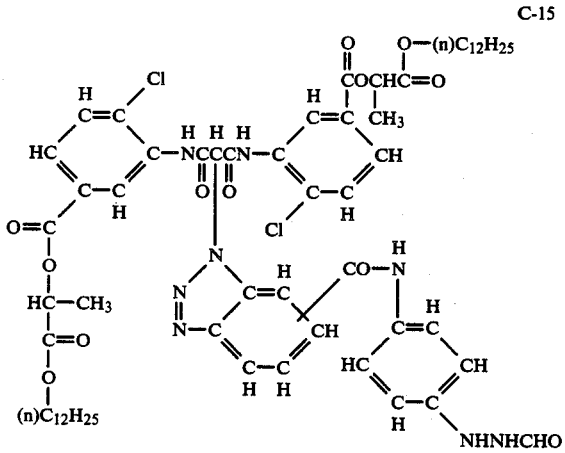
C-16
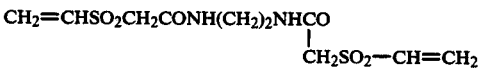

-continued
C-17
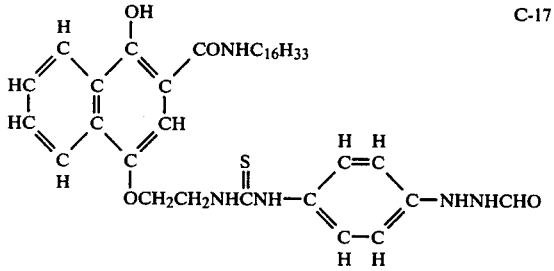
C-18
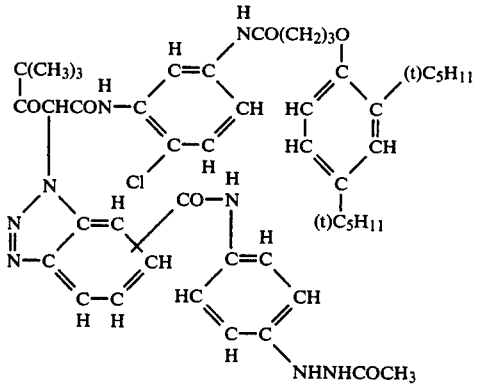
Sensitizing Dye A
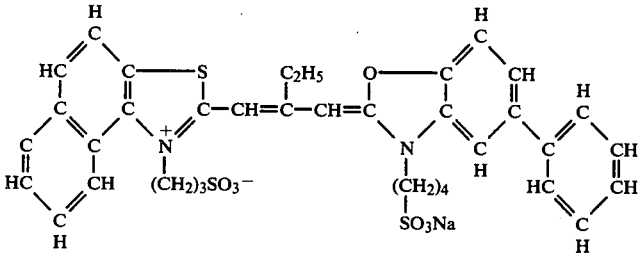
Sensitizing Dye B
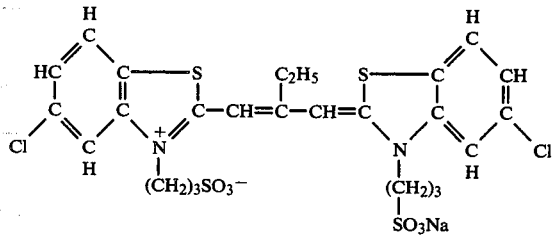
Sensitizing Dye C
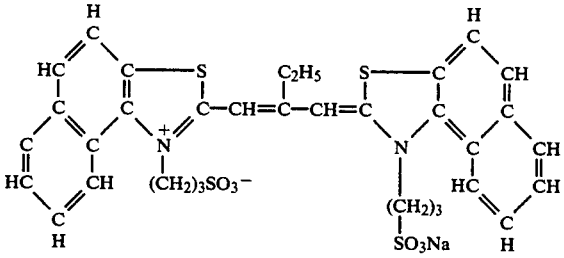
Sensitizing Dye D
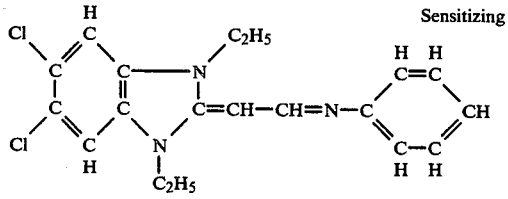
Sensitizing Dye I-7
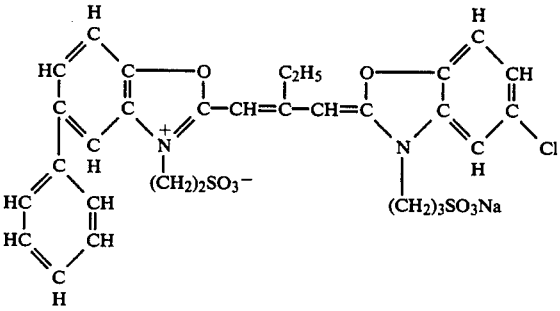
Sensitizing Dye II-6
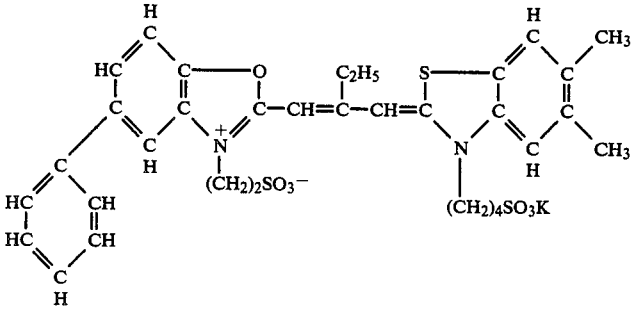

-continued

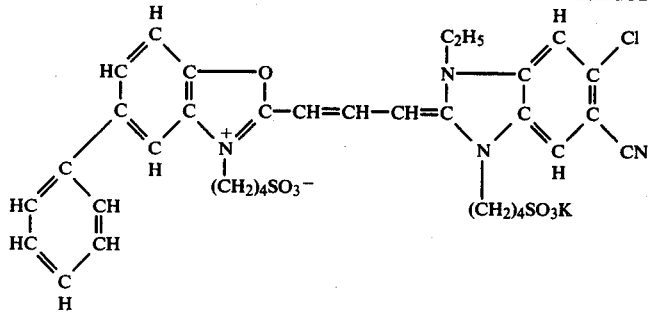

Sensitizing Dye III-3

Sensitizing Dye F

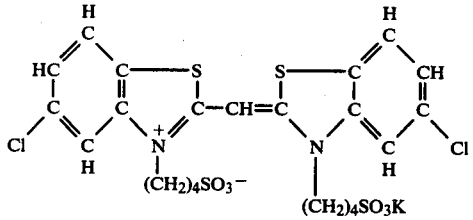

Sensitizing Dye E

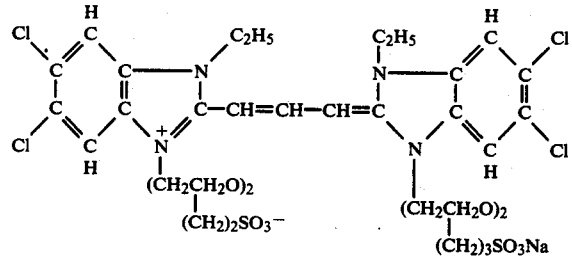

Preparation of Sample 102

Sample 102 was prepared in the same manner as Sample 101 except that an equal amount of tabular grains having a mean thickness of 0.3 μm and a mean aspect ratio of 8:1 was used in place of the spherical grains in the eighth layer, the amounts of Sensitizing Dye I-7 and Sensitizing Dye E used in the eighth layer were increased to $8\times10^{-4}$ mol per mol of silver and $3.3\times10^{-4}$ mol per mol of silver, respectively, to effect optimum color sensitization; the spherical grains in the ninth layer were replaced with an equal amount of tabular grains having a mean thickness of 0.3 μm and a mean aspect ratio of 13:1, and the amounts of Sensitizing Dye I-7 and Sensitizing Dye E used in the ninth layer were increased to $9\times10^{-4}$ mol per mol of silver and $3.6\times10^{-4}$ mol per mol of silver, respectively, to effect optimum color sensitization.

Preparation of Samples 103 to 105

Samples 103 and 104 were prepared in the same manner as Sample 102 except that Sensitizing Dye E used in Sample 102 was replaced by the same amount of Sensitizing Dye III-3 and Sensitizing Dye II-6, respectively, in equimolar amounts. Sample 105 was prepared in the same manner as Sample 102 except that 70% of Sensitizing Dye E was replaced by Sensitizing Dye III-3 and 30% of Sensitizing Dye E was replaced by Sensitizing Dye II-6.

Each of the thus prepared Samples 101 to 105 was subjected to white light exposure through a silver wedge for 1/100 second and then subjected development-processing.

The development-processing in this example was conducted at 38° C. as follows.

| | |
|---|---|
| 1. Color Development | 3 min. 15 sec. |
| 2. Bleaching | 6 min. 30 sec. |
| 3. Rinsing | 3 min. 15 sec. |
| 4. Fixing | 6 min. 30 sec. |

-continued

| | |
|---|---|
| 5. Rinsing | 3 min. 15 sec. |
| 6. Stabilization | 3 min. 15 sec. |

Composition of processing solutions used in the above steps are as follows.

| | |
|---|---|
| Color Developing Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |
| Bleaching Solution: | |
| Ammonium bromide | 160.0 g |
| Aqueous ammonia (28%) | 25.0 ml |
| Sodium (ethylenediaminetetraacetato)-ferrate (III) | 130.0 g |
| Glacial acetic acid | 14.0 ml |
| Water to make | 1.0 liter |
| Fixing solution: | |
| Sodium tetrapolyphosphate | 2.0 g |
| Sodium sulfite | 4.0 ml |
| Ammonium thiosulfate (70%) | 175 ml |
| Sodium bisulfite | 4.6 g |
| Water to make | 1.0 g |
| Stabilizing Solution: | |
| Formaldehyde | 8.0 ml |
| Water to make | 1.0 liter |

In order to evaluate stability during preservation over a long period, the samples were kept in dark at 30° C. and a relative humidity of 70% for 3 months and then exposed and processed in the manner described above. Furthermore, the effects of latensification after exposure were evaluated by maintaining the exposed samples at 50° C. and a relative humidity of 30% for 3 days and then processing the samples in the same manner as described above. The results obtained are shown in Table 1.

TABLE 1

| Sample No. | Green-Sensitivity | Reproducibility of Red | Distinction Between Orange and Red | Change in Fog during Pre-exposure Storage (30° C., RH 70%, 3 Mos.) | Change During Post-Exposure Storage (50° C., RH 30%, 3 Days) Sensitivity | Increase of Fog |
|---|---|---|---|---|---|---|
| 101 (Comparison) | 100 | good | good | 0.02 | +0.05 | 0.10 |
| 102 (Comparison) | 120 | good | good | 0.25 | +0.15 | 0.25 |
| 103 (Comparison) | 110 | good | difficult | 0.03 | ±0 | 0.05 |
| 104 (Comparison) | 120 | orange | slightly poor | 0.02 | ±0 | 0.05 |
| 105 (Invention) | 120 | good | good | 0.01 | ±0 | 0.05 |

From the results shown in Table 1, it was revealed that Sample 102 (comparison) has stability which is poor for practical use despite its high green sensitivity, while Samples 103 and 104 according to the present invention has both high sensitivity and excellent stability and Sample 105 according to the present invention has not only high sensitivity and excellent stability but also good color reproducibility.

EXAMPLE 2

Preparation of Samples 201 and 202

Samples 201 and 202 were prepared in the same manner as Sample 101 of Example 1 except for using the sensitizing dyes indicated in Table 2 below in place of Sensitizing dyes I-7 and E.

Preparation of Samples 203 to 205

Samples 203 to 205 were prepared in the same manner as Sample 105 of Example 1 except that Sensitizing Dyes I-7, II-6 and III-3 used in Sample 105 were replaced by equimolar amounts of the sensitizing dyes indicated in Table 2, respectively.

The same evaluation tests as described in Example 1 were conducted for the above-prepared samples, and the results obtained are shown in Table 2.

TABLE 2

| Sample No. | Sensitizing Dye* I | II | III | Green-Sensitivity | Reproducibility of Red | Distinction Between Orange and Red | Change in Fog During Storage Before Exposure (30° C., RH 70%, 3 Mos.) | Change During Storage After Exposure (50° C. RH 30%, 3 Days) Sensitivity | Increase of Fog |
|---|---|---|---|---|---|---|---|---|---|
| 201 (Comparison) | Ia-4 | IIa-4 | | 105 | Orange | slightly poor | 0.04 | ±0 | 0.04 |
| 202 (Comparison) | Ia-5 | IIa-2 | | 110 | orange | slightly poor | 0.03 | ±0 | 0.06 |
| 203 (Invention) | Ia-4 | IIa-1 | IIIa-1 | 115 | good | good | 0.04 | ±0 | 0.04 |
| 204 (Invention) | Ia-5 | IIa-2 | IIIa-2 | 120 | good | good | 0.03 | ±0 | 0.06 |
| 205 | Ia-1 | IIa-4 | IIIa-4 | 115 | good | good | 0.02 | ±0 | 0.06 |

Note: The sensitizing dyes used in Table 2 are the same as the specific examples above.

From the results shown in Table 2 above, it is seen that all of the light-sensitive materials according to the present invention have excellent sensitivity and stability during storage. In particular, it can be seen that Samples 203 to 205 exhibit excellent reproducibility of red and provide good distinction between orange color and red, indicating that the combined use of Sensitizing Dyes I, II and III produces especially good results.

While the invention has been described in detail and with reference to specific embodiments thereof, it will be apparent to those skilled in the art that various changes and modifications can be made therein without departing from the spirit and scope thereof.

What is claimed is:

1. A silver halide photographic light-sensitive material comprising a support and at least one silver halide emulsion layer, wherein at least about 50% of the total projected surface area of silver halide grains contained in said silver halide emulsion layer comprises tabular silver halide grains having a mean aspect ratio of at least about 5:1 and said emulsion layer contains a sensitizing dye represented by the following general formula (Ib), a sensitizing dye represented by the following general formula (IIb) and a sensitizing dye represented by the following general formula (IIIb):

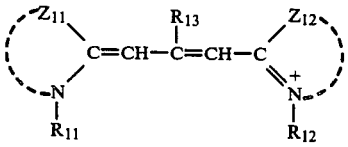

(Ib)

wherein $R_{11}$ and $R_{12}$, which may be the same or different, each represents a substituted or unsubstituted alkyl group, a substituted or unsubstituted alkenyl group or a substituted or unsubstituted aralkyl group; $R_{13}$ represents a hydrogen atom, an aryl group or an alkyl group having 1 to 4 carbon atoms; and $Z_{11}$ and $Z_{12}$, which may be the same or different, each represents a substituted or unsubstituted atomic group necessary to form an oxazole ring, a benzoxazole ring or a naphthoxazole ring together with the adjacent N and $N^{30}$, respectively, at least one of $R_{11}$ and $R_{12}$ being an alkyl group substituted with a carboxyl group or a sulfo group;

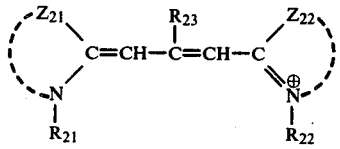

(IIb)

wherein $R_{21}$ and $R_{22}$, which may be the same or different, each represents a substituted or unsubstituted alkyl group, a substituted or unsubstituted alkenyl group or a substituted or unsubstituted aralkyl group; $R_{23}$ represents a hydrogen atom, an aryl group or an alkyl group having 1 to 4 carbon atoms; $Z_{21}$ represents a substituted or unsubstituted atomic group necessary to form an oxazole ring, a benzoxazole ring or a naphthoxazole ring together with N; and $Z_{22}$ represents a substituted or unsubstituted atomic group necessary to form a benzothiazole ring, a thiazole ring, a naphthothiazole ring, a selenazole ring, a benzoselenazole ring or a naphthoselenazole ring together with $N^+$, at least one of $R_{21}$ and $R_{22}$ being an alkyl group substituted with a carboxyl group or a sulfo group; and

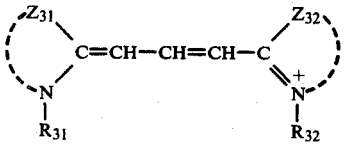

(IIIb)

wherein $R_{31}$ and $R_{32}$, which may be the same or different, each represents a substituted or unsubstituted alkyl group, a substituted or unsubstituted alkenyl group or a substituted or unsubstituted aralkyl group; $Z_{31}$ represents a substituted or unsubstituted atomic group necessary to form an oxazole ring, a benzoxazole ring or a naphthoxazole ring together with N; and $Z_{32}$ represents a substituted or unsubstituted atomic group necessary to form a benzimidazole ring or a naphthoxazole ring together with $N^+$, at least one of $R_{31}$ and $R_{32}$ being an alkyl group substituted with a carboxyl group or a sulfo group.

2. A silver halide photographic light-sensitive material as claimed in claim 1, wherein at least about 70% of the total projected surface area of silver halide grains contained in said silver halide emulsion layer comprises tabular silver halide grains having a diameter of about 0.6 to 5.0 μm, a thickness of not more than about 0.2 μm and a mean aspect ratio of about 5:1 to 50:1.

3. A silver halide photographic light-sensitive material as claimed in claim 1, wherein at least about 85% of the total projected surface area of silver halide grains contained in said silver halide emulsion layer comprises tabular silver halide grains having a diameter of about 1.0 to 5.0 μm and a mean aspect ratio of about 8:1 to 50:1.

4. A silver halide photographic light-sensitive material as claimed in claim 1, wherein at least one of $R_{11}$ and $R_{12}$, at least one of $R_{21}$ and $R_{22}$, and at least one of $R_{31}$ and $R_{32}$ is an alkyl group substituted with a carboxyl group or a sulfo group.

5. A silver halide photographic light-sensitive material as claimed in claim 1, wherein the sensitizing dye represented by general formula (Ib) is a compound represented by general formula (Ia):

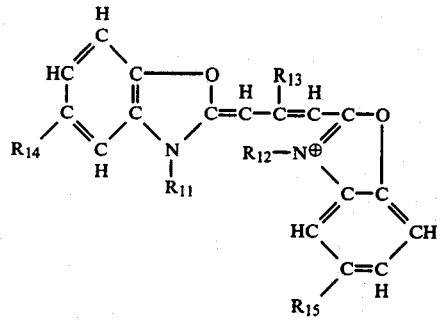

(Ia)

wherein $R_{11}$, $R_{12}$ and $R_{13}$ are as defined in claim 1; and $R_{14}$ and $R_{15}$, which may be the same or different, each represents a hydrogen atom, a hydroxy group, a halogen atom, a substituted or unsubstituted alkyl group, a substituted or unsubstituted aryl group, an aralkyl group, an alkoxy group, a carboxyl group, an alkoxycarbonyl group or an acylamino group.

6. A silver halide photographic light-sensitive material as claimed in claim 1, wherein the sensitizing dye represented by general formula (IIb) is a compound represented by general formula (IIa):

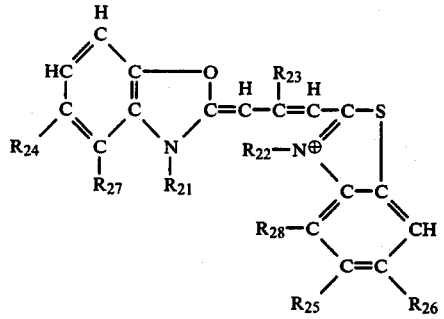

(IIa)

wherein $R_{21}$, $R_{22}$ and $R_{23}$ are as defined in claim 1, $R_{24}$, $R_{25}$ and $R_{26}$, which may be the same or different, each represents a hydrogen atom, a hydroxy group, a halogen atom, a substituted or unsubstituted alkyl group, a substituted or unsubstituted aryl group, an aralkyl group, an alkoxy group, a carboxyl group, an alkoxycarbonyl group or an acylamino group; $R_{27}$ represents a hydrogen atom or an atomic group necessary to form a benzene ring together with $R_{24}$; and $R_{28}$ represents a hydrogen atom or an atomic group necessary to form a benzene ring together with $R_{25}$.

7. A silver halide photographic light-sensitive material as claimed in claim 1, wherein the sensitizing dye represented by general formula (IIIb) is a compound represented by general formula (IIIa):

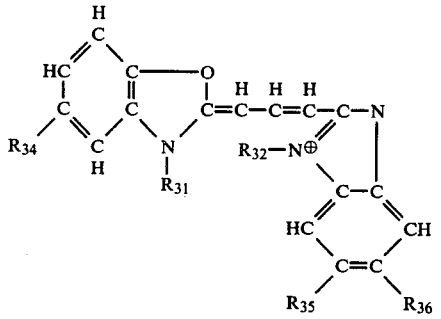

(IIIa)

wherein $R_{31}$ and $R_{32}$ are as defined in claim 1; $R_{34}$ represents a hydrogen atom, a hydroxy group, a halogen atom, a substituted or unsubstituted alkyl group, a substituted or unsubstituted aryl group, an aralkyl group, an alkoxy group, a carboxyl group, an alkoxycarbonyl group or an acylamino group; $R_{35}$ represents a cyano group, an acyl group, an alkylsulfonyl group, an alkylsulfinyl group, an alkoxycarbonyl group, a trifluoromethyl group or a halogen atom; and $R_{36}$ represents a hydrogen atom or a chlorine atom.

8. A silver halide photographic light-sensitive material as claimed in claim 1, wherein the total amount of said sensitizing dyes (Ib), (IIb) and (IIIb) in said emulsion layer is from about $1\times10^{-6}$ to $5\times10^{-3}$ mol per mol of silver in said emulsion layer.

9. A silver halide photographic light-sensitive material as claimed in claim 8, wherein the total amount of said sensitizing dyes (Ib), (IIb) and (IIIb) in said emulsion layer is from about $1\times10^{-5}$ to $2.5\times10^{-3}$ mol per mol of silver in said emulsion layer.

10. A silver halide photographic light-sensitive material as claimed in claim 1, wherein the sensitizing dye represented by general formula (IIb) is present in an amount of from about 0.01 to 0.5 mol per mol of the sensitizing dye represented by general formula (Ib).

11. A silver halide photographic light-sensitive material as claimed in claim 10, wherein the sensitizing dye represented by general formula (IIb) is present in an amount of from about 0.05 to 0.3 mol per mol of the sensitizing dye represented by general formula (Ib).

12. A silver halide photographic light-sensitive material as claimed in claim 1, wherein the sensitizing dye represented by formula (IIIb) is used in an amount of from about 0.1 to 1.0 mol per mol of the sensitizing dye represented by general formula (Ib).

13. A silver halide photographic light-sensitive material as claimed in claim 12, wherein the sensitizing dye represented by general formula (IIIb) is used in an amount of from about 0.2 to 0.5 mol per mol of the sensitizing dye represented by general formula (Ib).

14. A silver halide photographic light-sensitive material as claimed in claim 1, wherein said silver halide emulsion layer comprises silver iodobromide containing not more than about 15 mol percent of iodide.

15. A silver halide photographic light-sensitive material as claimed in claim 1, wherein said material is a color photographic material comprising at least one red-sensitive emulsion layer, at least one green-sensitive emulsion layer and at least one blue-sensitive emulsion layer, wherein said green-sensitive emulsion layer further comprises the sensitizing dye represented by following general formula (Ib) and general formulae (IIb) and (IIIb) and a benzimidazole sensitizing dye.

16. A silver halide photographic light-sensitive material as claimed in claim 1, wherein the molar ratio of said sensitizing dyes (Ib):(IIb):(IIIb) is 1:0.01 to 0.5:0.1 to 1.0.

17. A silver halide photographic light-sensitive material as claimed in claim 16, wherein said molar ratio is 1:0.05 to 0.3:0.2 to 0.5.

* * * * *